US005330194A

United States Patent [19]

Copeland

[11] Patent Number: 5,330,194

[45] Date of Patent: Jul. 19, 1994

[54] GOLF BALL DELIVERY DEVICE

[76] Inventor: William W. Copeland, P.O. Box 1624, Desloge, Mo. 63601

[21] Appl. No.: 42,678

[22] Filed: Apr. 5, 1993

[51] Int. Cl.[5] ..... A63B 69/36

[52] U.S. Cl. ..... 273/201

[58] Field of Search ..... 273/32.5, 33, 201

[56] References Cited

U.S. PATENT DOCUMENTS

| | | | |
|---|---|---|---|
| 1,545,959 | 7/1925 | Huyler | 273/201 |
| 1,598,971 | 9/1926 | Kenyon | 273/201 |
| 1,667,481 | 4/1928 | Lange et al. | 273/201 |
| 1,888,256 | 11/1932 | Baumgartner | 273/201 |
| 1,935,291 | 11/1933 | Gardner et al. | 273/201 |
| 2,127,282 | 8/1938 | Beckett | 273/201 |
| 3,458,204 | 7/1969 | Wilson | 273/201 |
| 3,901,515 | 8/1975 | Mozel | 273/201 |
| 4,732,391 | 3/1988 | Karr | 273/201 |

FOREIGN PATENT DOCUMENTS

| | | | |
|---|---|---|---|
| 2231803 | 11/1990 | United Kingdom | 273/201 |

*Primary Examiner*—William E. Stoll
*Attorney, Agent, or Firm*—Paul M. Denk

[57] ABSTRACT

A golf ball delivery device having a housing, a ball feeder adjacent to a housing for supplying the delivery device with balls, a ball channel integral to the housing for guiding balls from the feeder to a tee, a tee for supporting a ball, a piston attached to the tee for reciprocating the tee from ball receiving position to ball driving position, a delivery mechanism for incrementally delivering balls to the tee, the further improvement comprising a pivot handle in communication with the piston for activating the delivery device.

7 Claims, 4 Drawing Sheets

GOLF BALL DELIVERY DEVICE

BACKGROUND OF THE INVENTION

This invention relates to a golf ball delivery device for use in the practice driving of golf balls, and more particularly, to a golf ball delivery device with a pivot handle for activating the device.

Most of the present devices for practicing golf drives, as for example at a driving range, require replacing a golf ball onto a tee following each drive. When a golfer practices for a substantial amount of time, the process of continually stooping down to replace the ball onto the tee becomes tiresome.

Several attempts have been made to manufacture golf driving devices that allow the golfer to maintain driving position throughout the process of supplying a tee with a ball in preparation for a drive and then driving the ball. Some examples or prior type automatic golf ball teeing devices can be seen in the U.S. Pat. No. 2,295,599, which shows a form of automatic golf ball teeing device. This particular device utilizes a teeing mechanism, that shifts vertically within a housing, to lift a ball upwardly, into a teeing position above the shown mat, after the ball is delivered from a chute. A stop mechanism allows one ball at a time to be delivered from the chute into the housing. Furthermore, various electronic means are applied for determining when the next ball is required to be delivered by the tee to the surface of the driving mat.

The United States patent to Monasco, U.S. Pat. No. 4,832,345, shows a golf ball teeing apparatus, with a motor means operative with linkage assembly, for lifting of a piston member, for raising a golf ball above its driving surface.

The United States patent to Blaski, U.S. Pat. No. 2,152,680, shows a mechanical teeing apparatus, using a gravity feed type of chute arrangement, whereby the balls are delivered down a tube, to a ball delivery mechanism, which delivers the next ball to the surface of the platform, when the photocells detect that a ball is not present.

The patent to Hogeberg, U.S. Pat. No. 2,335,280, shows another golf ball teeing mechanism. The various mechanisms utilized in this particular device includes a ball storage container, a chute, for delivery of the balls down to a tube, whereby a flywheel or eccentric wheel mechanism delivers the balls by means of a plunger for lifting them upon the tee, to the floor of the driving device.

The patent to Shouse, U.S. Pat. No. 2,450,206, shows another golf tee apparatus, and this particular apparatus is pertinent from the standpoint as showing the usage of lever means, which delivers a ball by means of mechanical pressure, as by the foot of the player applied to a disc, in order to shift the ball teeing mechanism or its plunger vertically within its delivery cylinder.

Another patent to Mozel, U.S. Pat. No. 2,639,919, shows a coin controlled ball teeing machine. This particular device utilizes a ball delivery chute which delivers the balls to a lift arm, all in response to the insertion of coins into a coin actuator.

Another patent to Hogeberg, U.S. Pat. No. 2,696,985, shows another form of ball delivery device, but this particular device operates in conjunction with a solenoid operative teeing mechanism, which delivers the golf ball through a tube, upon actuation of a plunger, which is rendered operative through the operations of a solenoid coil, that provides the means for lifting the ball above the driving mat.

The United States patent to McGraw, U.S. Pat. No. 2,711,321, shows another golf ball teeing apparatus, and in this particular instance, the gravity means is provided for delivery of the balls to a member, with a foot actuated lever mechanism providing the means for lifting the ball above the shown mat. Foot pressure is used for depressing the pedal, to initiate the action.

The patent to Willcox, U.S. Pat. No. 2,789,824, shows another type of golf ball dispensing and teeing machine. The balls are delivered by means of an inclined trough, to a tee, where the ball is electronically raised upon its tee through the functioning of the shown tee arm.

Another patent to Mozel, U.S. Pat. No. 2,838,313, discloses a golf ball teeing mechanism, which has the usual bin and chute for delivery of balls to the tee device, passes the balls over a track to the tee, with a motor means providing the means for raising the tee for delivery of the ball for driving.

The patent to Scott, U.S. Pat. No. 3,294,402, shows what is identified as golf ball teeing device with photocell and counter operated control means. As can be seen, the motor means operates in conjunction with its rocker bar, and is used for pushing the teed ball above the flat deck or platform, after the balls are delivered by means of gravity flow.

The patent to Turnau, U.S. Pat. No. 3,298,694, provides an automatic golf ball teeing device. This device also utilizes a magazine or chute providing for the gravity flow of balls to the shown tee. Then, a pneumatic cylinder provides a means for lifting of a ball, by way of pressurized air above the cover surface, as required.

Another patent to Turnau, U.S. Pat. No. 3,378,263, shows a little more detail relating to the mechanical operations, by pneumatic pressure, for automatically lifting a golf ball upon its tee, during functioning.

The patent to Scott, U.S. Pat. No. 3,448,985, shows a golf ball teeing apparatus, with this device utilizing a motor for raising its connecting rod, and its associated tubular mounting end, for elevating the ball above the shown platform.

The patent Meierjohan, U.S. Pat. No. 3,519,275, discloses an automatic golf ball teeing device, which utilizes gravity flow for delivery of the balls, then electrically operates various conductors for providing lifting of the tee, through the elevation of carriage means, during usage of the device.

The patent to Diamandis, U.S. Pat. No. 4,815,744, shows an automatic golf ball tee assembly. This device utilizes a rack and pinion type of lifting mechanism, the rack being designated as shown, while the driving pinion comprises the gear member. Motor means provides for energization of the rack and pinion lifting mechanism, upon operation of its shown switch member.

While all of the aforementioned examples have worked well for their intended purpose, there are several noticeable limitations which have not been solved by prior art designs. One limitation is the maintenance and cost involved in operating a motor means for golf ball delivery devices. Motors often become worn and fail to operate effectively. Removing the motor from the device for repair is cumbersome and costly. Furthermore, motor means exposed for any prolonged time to inclement weather can deteriorate. Another limitation in some of the present art devices utilizing motor means is that activation of the device occurs instantly following the drive. The device is not triggered at will by the golfer, but the process occurs automatically. Therefore, a new ball is placed into driving position even when the golfer wishes to refrain from driving.

Another limitation in devices that permit activation at will is that the golfer must change positions to initiate the delivery process. For example, the golfer must move from golfing position to insert a coin and then move to resume golfing position. A substantial amount of time is spent reciprocating from driving position to a position in which the device may be activated.

SUMMARY OF THE INVENTION

One of the objects of the present invention is to provide a golf ball delivery device that is cost effective.

Another object is to provide a golf ball delivery device that does not require frequent repairs.

A further object is to provide a golf ball delivery device that is activated at will.

Another object is to provide a golf ball delivery device that is activated without requiring the golfer to relocate from device activation position to driving position.

Another object is to provide a golf ball delivery device that is easy to activate.

Still another object is to provide a ball set up device that is compact, of unified construction, and therefore, facile of installation.

Other objects of this invention will be apparent to those skilled in the art in light of the following description and accompanying drawings.

In accordance with this invention, generally stated, a golf ball delivery device is provided which includes a housing, a ball feeder for supplying the delivery device with balls, a ball channel for guiding balls from the feeder to a tee, the tee for supporting a ball, a piston attached to the tee for reciprocating the tee from ball receiving position to ball driving position, a delivery mechanism for incrementally delivering balls to the tee, the improvement comprises a pivot handle in communication with the piston for activating the delivery device. The improvement of the present invention provides a device where activation occurs without having to stoop over or move out of driving position, and even can be performed by the golfer manually using his/her golf club.

It is to be understood that various changes may be made by one skilled in the golf ball delivery device art to one or more of the features of the device disclosed herein without departing from the scope or spirit of the present invention.

BRIEF DESCRIPTION OF THE DRAWINGS

Referring to the drawings which disclose one advantageous embodiment of the present invention and several modifications thereof.

DESCRIPTION OF THE PREFERRED EMBODIMENT

Figure 1:
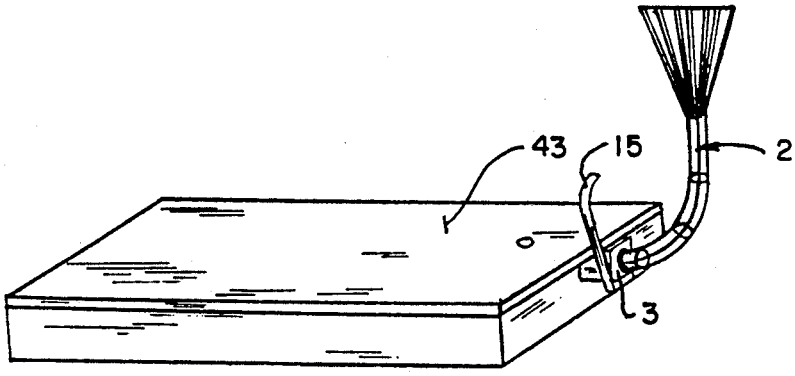
FIG. 1 is an isometric view of one illustrative embodiment of a golf ball delivery device operatively associated with a platform.

Referring now to the drawings for one illustrative embodiment of ball delivery device of this invention, reference numeral 1 indicates a completed assembly, ready for use in practice golfing, particularly the driving function.

In particular, the ball delivery device 1 includes a ball feeder 2 attached to a device housing 3. Ball feeder 2 gravity feeds balls into device 1. Balls enter housing 3 into a ball channel 5. Ball channel 5 guides balls through housing 3 from the feeder 2 to a teeing device. Ball feeder 2 supplies a new ball to device 1 as activation occurs following each drive. A delivery mechanism 25 controls the individual supply of balls to tee 4. Delivery mechanism 25 releases the balls individually.

Figure 7:
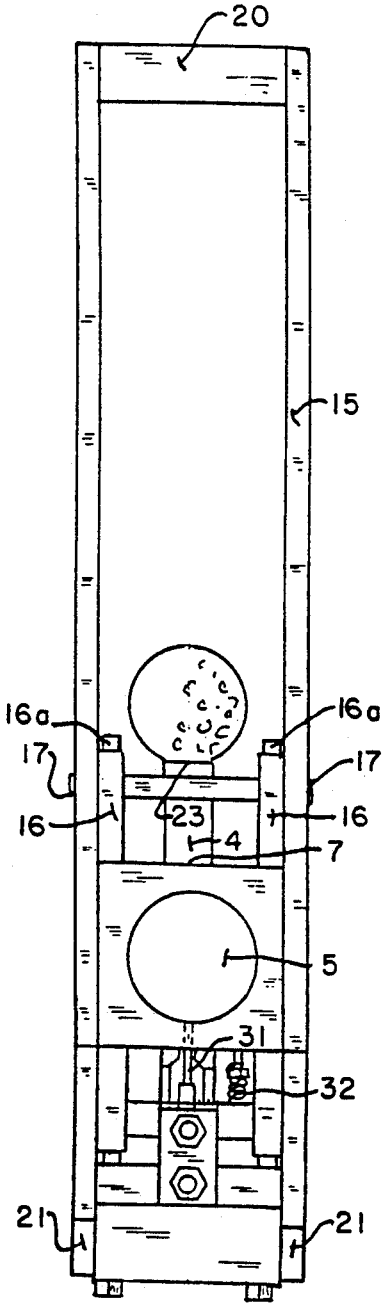
FIG. 7 is a view in front elevation of the golf ball delivery device in ball driving position, as shown in FIG. 3.
Figure 8:
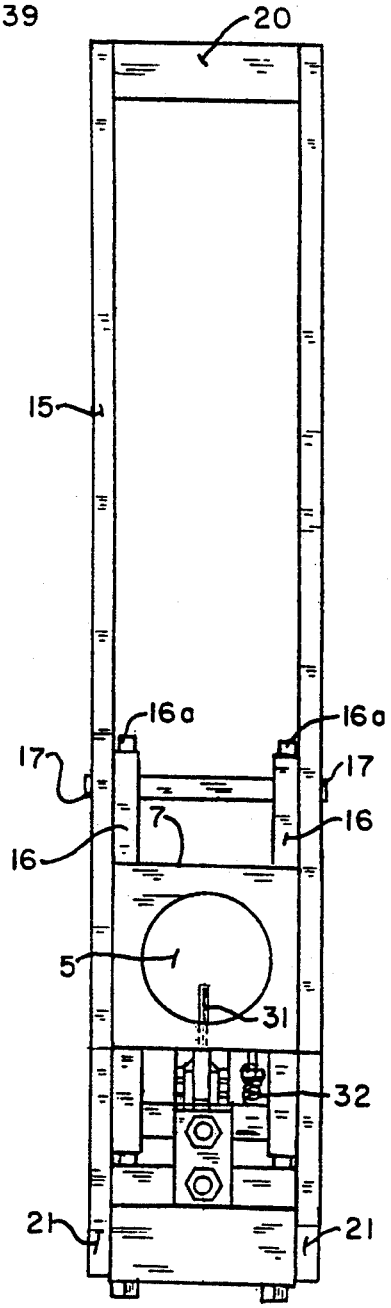
FIG. 8 is a view in front elevation of the golf ball delivery device in ball receiving position, as shown in FIG. 4.

Tee 4 has an enlarged flanged base **4*a* which adheres to a piston 6. The piston 6 reciprocates tee 4 from a ball receiving position to a ball driving position. Ball receiving position shown in FIGS. 4, 8 and 10 includes situating piston 6 below the surface of ball channel 5 so that tee top 23 may receive a golf ball. Ball driving position shown in FIGS. 5, 7, and 9 includes situating piston 6 so that tee 4 abutts through platform surface 7. A cylinder 8 encloses piston 6** and helps maintain vertical alignment of the piston.

Shafts 9 extending from either side of piston 6 extend outwardly through elongated slots 10 in cylinder 8. Elongated slots 10 are sized to guide shafts 9 through their entire range of motion from ball driving position to ball receiving position. Levers 11 fit onto piston 6 over shafts 9. Levers 11 connect to shafts 9 on the outside of the housing 3 through lever openings 12 sized to embrace shafts 9. The shafts 9 protrude through lever openings 12 and are positioned via pivot pins 13. Pivot pins 13 screw through aligned apertures 14 in shafts 9 and hold piston 6 in proper alignment within cylinder 8.

Figure 2:
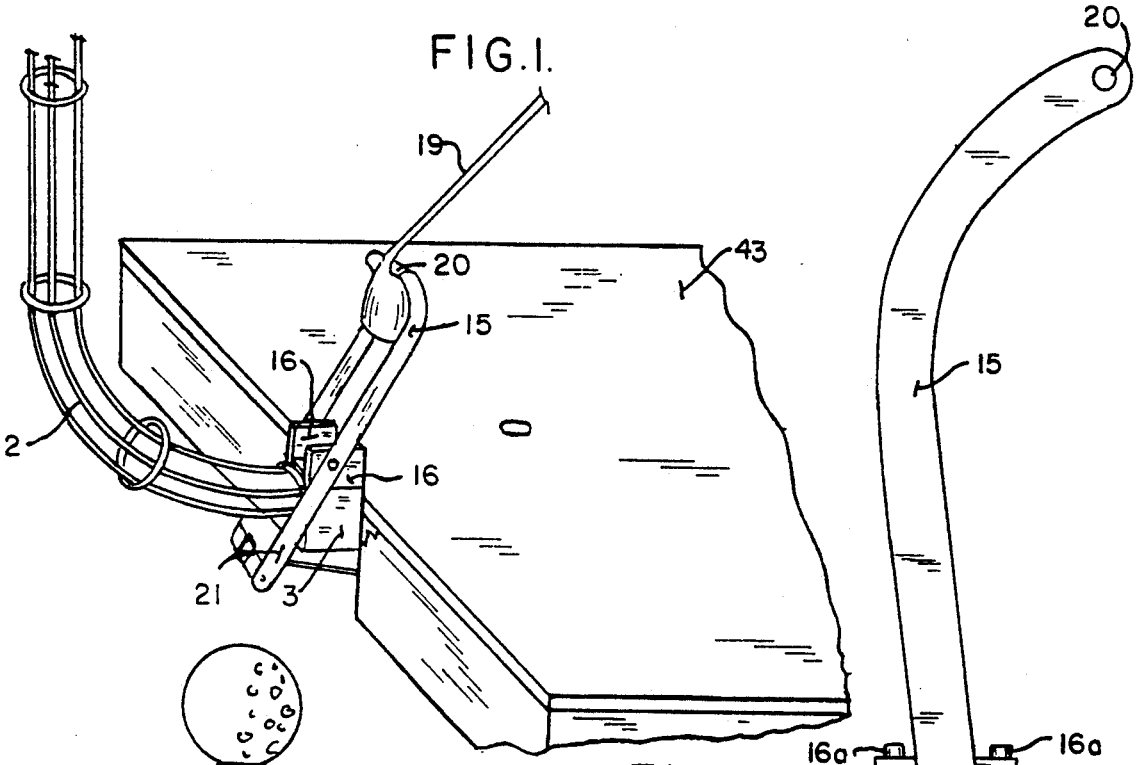
FIG. 2 is a partial view in isometric of a golf ball delivery device covered by a platform being activated by a golf club.
Figure 3:
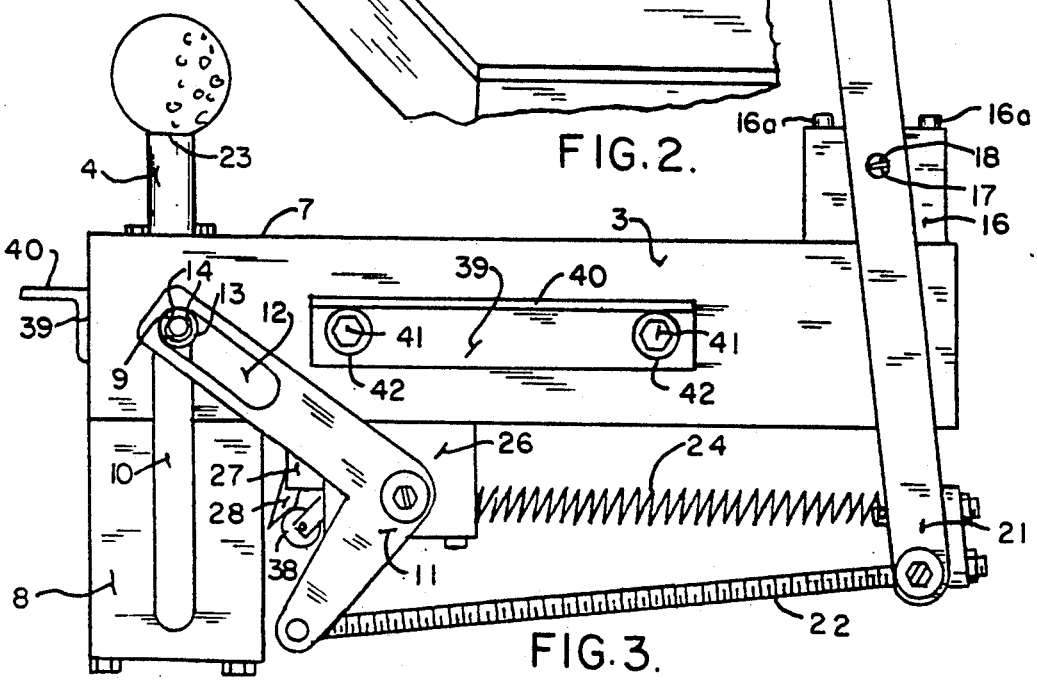
FIG. 3 is a right side view in side elevation of the golf ball delivery device of this invention in ball driving position.
Figure 4:
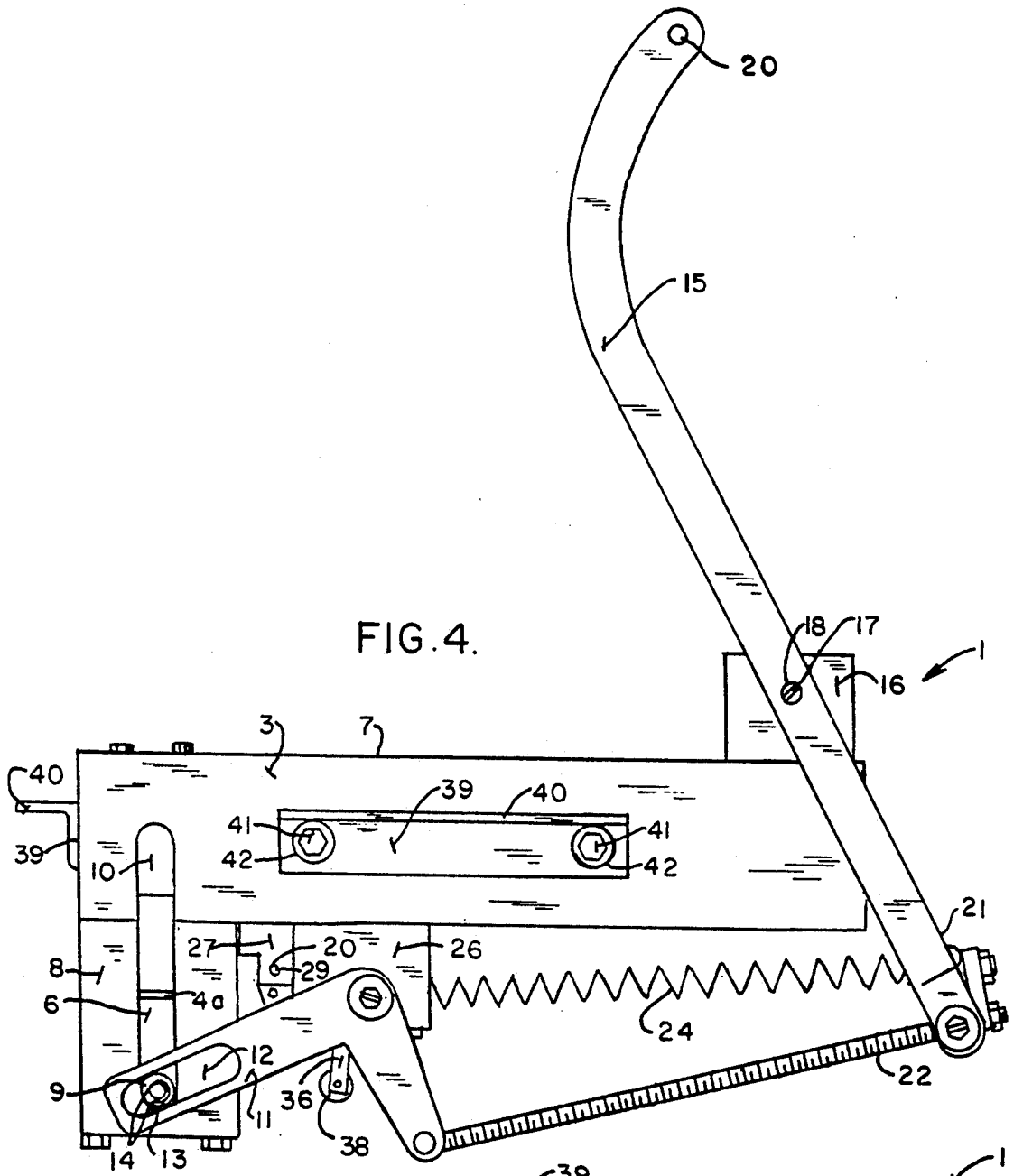
FIG. 4 is a left side view in side elevation of a golf ball delivery device in ball receiving position.
Figure 5:
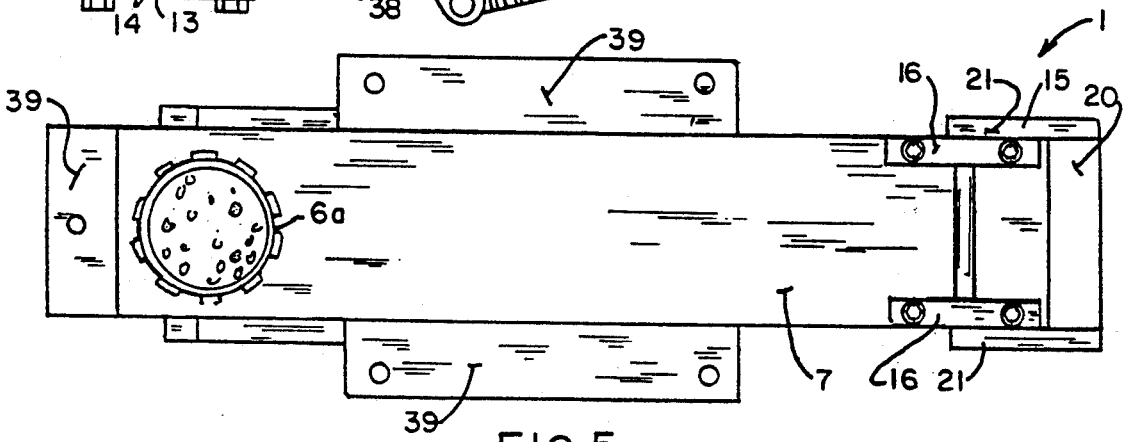
FIG. 5 is a view in top plan of the golf ball delivery device in ball driving position, as shown in FIG. 3.
Figure 6:
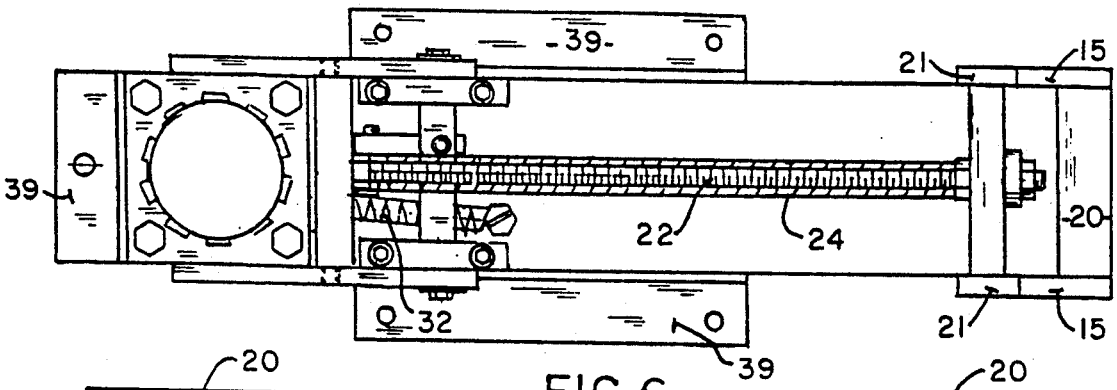
FIG. 6 is a view in bottom plan of the golf ball delivery device in ball driving position.

A pivot handle 15 attaches to housing 3 for activating golf ball delivery device 1. Pivot handle 15 manually reciprocates from ball receiving position to ball driving position. A pair of pillow blocks 16 are mounted to the top of the housing 3, at one end, for securing handle 15 into a position suitable for pivoting. A pair of mounting pins or screws **16*a* fix pillow blocks 16 to housing 3. Handle 15 secures to pillow blocks 16 by pivot pin 17. Pivot pin 17 latches through aligned apertures 18 in pillow blocks 16. Pivoting handle 15 towards tee 4 activates device 1 into a ball delivery function, as can be seen. In the embodiment shown in FIG. 2, handle 15 is pivoted by means of the golf club head 19. This embodiment eliminates the need for the golfer to bend over to tee up the next ball, club 19 initiating delivery of a ball to the surface platform 7. More specifically, handle 15 has a handle bar 20 sized to be engaged by the golf club head. The golf club 19 hooks onto handle bar 20 to pull handle 15 towards tee 4. Movement of handle 15 towards tee 4 pivots the handle bottom 21 away from device 1, as can be seen in FIG. 4. A rod 22, attached to handle bottom 21 moves away from device 1 with handle 15. Rod 22 is pivotally connected to levers 11. Therefore, as handle 15 pivots and pulls rod 22, it causes levers 11 to move downwardly. Levers 11 pull piston 6 downwardly further within the cylinder 8. This downward movement of piston 6 within cylinder 8, moves the tee top 23 downwardly. Tee top 23 descends to a position level with the lower surface of ball channel 5. This lowering allows the next ball to drop into cylinder 8 and rest upon tee top 23. When handle 15 is released, a tension spring 24 pulls handle bottom 21 forwardly causing levers 11 to pivot pushing piston 6 upwardly. Spring 24 returns handle 15 to the steady state position and piston 6 elevates to its ball setting condition, wherein the golf ball will then be at a position approximately an inch or so above platform surface 7 as seen in FIG. 3. At this stage, the ball is in position for driving. To reactive device 1, the golfer pivots handle 15 toward tee 4. Handle 15 pulls piston 6 downwardly and the next ball in the channel 5 drops onto tee top 23 in preparation for elevation above the platform surface 7**.

Figure 9:
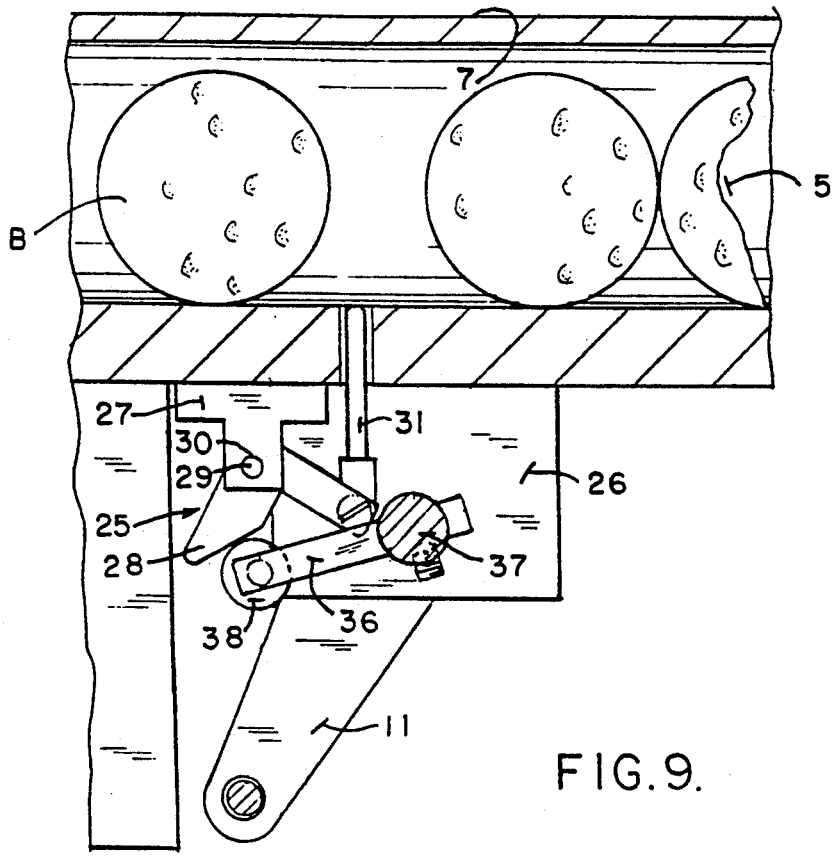
FIG. 9 is a partial view in cross section of a ball channel and positioning means of the golf ball delivery device, in ball driving position.
Figure 10:
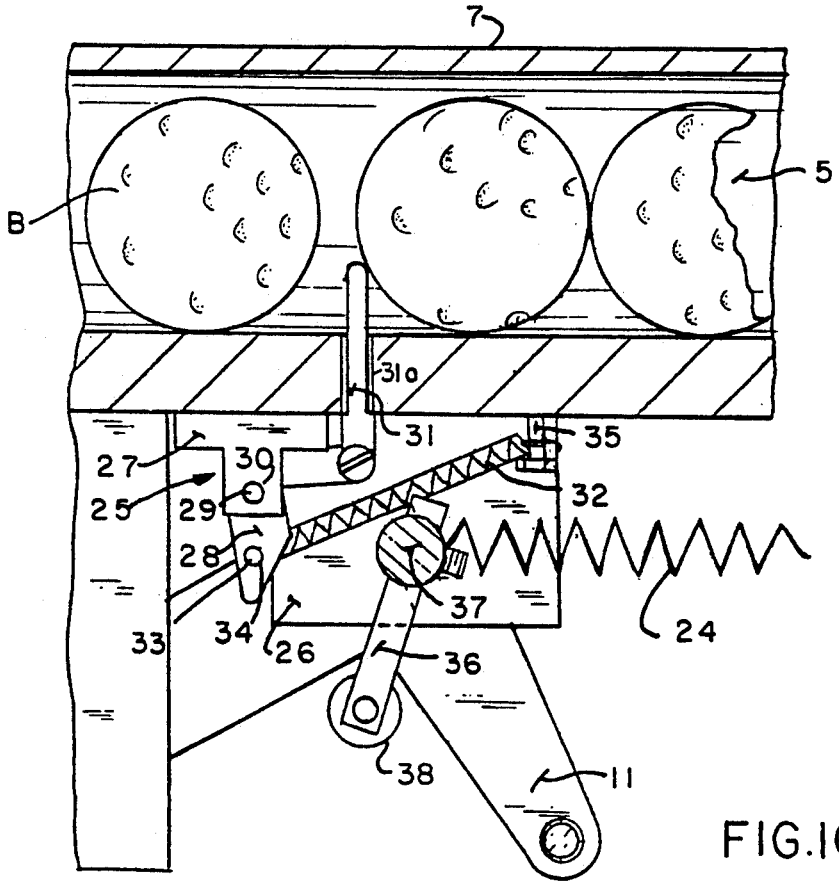
FIG. 10 is a partial view in cross section of a ball channel and positioning means of the golf ball delivery device in ball receiving position.

Delivery mechanism 25 mounts to the underside of housing 3 by a support block 26. The delivery mechanism 25 allows incremental and individual delivery of the balls to tee 4. Delivery mechanism 25 includes a brace 27 that mounts to the underside of housing 3. See FIGS. 9 and 10. Brace 27 provides a surface to secure a rocker arm 28. Pivot pin 29 fits through an opening 30 in brace 27 pivotally mounting rocker arm 28 to brace 27. At the end of rocker arm 28 there is pivotally connected a ball stop pin 31. At the other end of rocker arm 28, nearest to tee 4, is a spring 32. A pin 33 fits through opening 34 to secure one end of spring 32 to rocker arm 28. The opposite end of spring 32 connects to housing 3 at a ledge 35. Spring 32 is positioned in proximity with a lever bar 36, so that movement of lever bar 36 away from spring 24 activates spring 32. Spring 32 pulls upon the rocker arm 28 and elevates pin 31 into a position restraining the subsequent balls from flowing within channel 5, as shown in FIG. 10. Lever bar 36 includes an end member 37 and a left end member 38. End member 37 is connected to spring 24, whereas left end member 38 is in proximity and simultaneously pivots with lever 11.

When handle 15 is pivoted, toward tee 4, rod 22 is pulled rearwardly away from tee 4, pulling levers 11 rearwardly a fixed distance. As rod 22 moves, lever bar 36 is pulled rearwardly a slight distance pulling cam member 38 downward. Spring 32 is free to pull upon arm 28. Spring, 32 pulls rocker arm 28 a slight distance. When rocker arm 28 pivots at pin 29, the ball stop pin 31 extends upwardly through the opening **31*a* provided through the underside of housing 3. When pin 31 is in the position of blockage, as shown in FIG. 10, this prevents the subsequent golf balls from being delivered forwardly within channel 5, with the exception of one ball B, which is shifted into position in preparation for when a new ball is desired. Release of handle 15 shifts rod 22 forwardly towards tee 4, and pivots pin 31 downwardly and out of housing 3. When pivot pin 31 shifts downwardly, the next golf ball B enters into ball channel 5 in preparation for the next ball delivery cycle. The just preceeding ball drops into cylinder 8 and rests on tee 4 until elevated above platform 7**.

Platform braces 39 secure to the sides of housing 3 by fitting bolts 41 through housing openings 42. Braces 39 may be used to attach the underside of surface 43, for securement of device 1. In one embodiment shown in FIGS. 1 and 2, device 1 is covered with astroturf.

In operation, and to reiterate with respect to the structural relationship of the various components that make up the golf ball delivery device of this invention, as can be seen in FIG. 3, when a ball is resting upon the tee 4, upwardly of the surface 43, it is in position for being driven by the golf club. When in that position, as can be seen in FIG. 3, the handle 15 is automatically pivoted rearwardly, by means of the biasing spring 24. Likewise, the levers 11, through the fixed arrangement with the rod 22, sustains the golf ball upwardly, upon its tee 4. But, when in that position, there are a series of supplmental balls arranged within the ball channel 5, and when in that condition, as can be seen in FIG. 9, the levers 11 will be arranged downwardly, the lever bar 36 will be pivoted upwardly, because it is rigidly affixed to the pivotal end member 37, which also mounts the levers 11, and when pivoted clockwise, or into the position as shown in FIG. 9, its cam 38 biases against the camming surface of the rocker arm 28, thereby pulling the pin 31 downwardly, and allowing the golf ball B to shift within the channel 5, in preparation for the next ball delivery sequence. When the golf ball resting upon the tee 4, as shown in FIG. 3, is then driven, and the club head of the golf club 19 engages the handle bar 20, and pulled, which in effect pivots the upper portion of the handle 15 forwardly, in the manner as shown in FIG. 2, this locates the various operating mechanisms for the delivery device into the position as shown in FIG. 4. When in that position, the lower end of the handle 15 shifts rearwardly, as noted, pulling its rod 22 with it, which effects a shifting of the levers 11, pivoting them with respect to their pivot pin 37. Simultaneously, the pivoting counterclockwise of the levers 11 pulls the piston 6 downwardly, also withdrawing downwardly the tee 4, until its upper edge is generally in alignment with the bottom of the channel 5, in preparation for delivery of the next ball. But, simultaneously the lever bar 36 is pivoted counterclockwise, as can be seen in FIG. 10, out of engagement with the lower disposed caming surface of the rocker arm 28, so that the spring 32 pulls the rocker arm 28 rearwardly, or in a counterclockwise direction, thereby pivoting its connected pin 31 upwardly, into the position as shown in FIG. 10. This prevents all of the subsequent golf balls from moving to the left, or downwardly within the channel 5, with the exception of that one ball B, that previously passed the lower pin 31. When in this position, and since the tee 4 and its supporting piston 6 are now descended, the ball B is allowed to pass out of the channel 5, into the piston opening, as shown at **6*a*, as in FIG. 5, so that ball B comes to rest upon the tee 4, with all of the remaining balls being held by means of the pin 31. Then, when the golf club 19 allows the handle 15 to pivot rearwardly, as this occurs, the rod 22 shifts forwardly, pivoting the levers 11, so that the shafts 9 shift upwardly, moving the piston 6 upwardly, and disposing its tee above the surface of the platform 43, with a golf ball resting thereon, in preparation for the next drive. Simultaneously, as this occurs, the lever bar 36 pivots with the levers 11, until its cam end 38 engages the camming surface provided along the lower edge of the rocker arm 28, pivoting it clockwise, thereby pulling the pin 31 downwardly, which allows the golf ball to shift approximately one ball position further downwardly within the channel 5, so as to position the next ball B into that position for its delivery into the opening 6***a*, as when the piston and its tee 4 are once again shifted downwardly, after the preceding ball has been driven, in preparation for set up of the next subsequent golf ball B into a position for its eventual drive.

Numerous variations, within the scope of the appended claims will be apparent to those skilled in the art in light of the foregoing description and accompanying drawings. It is intended that all matter contained in the above description or shown in the accompanying drawings shall be interpreted as illustrative and not in a limiting sense.

Having thus described the invention, what is claimed and desired to be secured by Letters Patent is:

1. In a golf ball delivery device for the automatic delivery of golf balls to a tee for driving, said device having a housing, a ball feeder adjacent to one end of said housing, said ball feeder provided for supplying said delivery device with golf balls, a ball channel integrally provided within said housing, said channel provided for guiding golf balls from said ball feeder to said tee, said tee provided for supporting a ball for driving, a piston attached to the underside of said tee, said piston provided for reciprocating said tee from a lower ball receiving position to an elevated ball driving position, a delivery mechanism for incrementally delivering balls to the lowered tee, a platform covering said device, said platform having an aperture therethrough for elevating of the next golf ball upon a tee into position for driving, a pivot handle mechanically communicating with said piston which upon activating said delivery device, automatically delivers a golf ball from the housing channel and onto the tee for elevating into a driving position, said housing having a piston channel therein, said piston capable of vertically reciprocating within said piston channel, said piston channel disposed for guiding said piston into position in alignment with said ball channel for receiving the next golf ball upon the tee and for elevating the ball into a ball driving position, the ball receiving position comprising said piston retracting below the surface of said ball channel, thereby enabling the top of the said tee to be at least in alignment with the bottom edge of the ball channel and to receive the next golf bal thereon in preparation for elevating the ball into a ball driving position, the ball driving position comprising said piston being elevated to a position upwardly within the piston channel, thereby arranging the golf ball supported upon the tee at a position above said platform in preparation for a drive, said pivot handle being mounted to the device and capable of pivoting forwardly or rearwardly with respect to the device, lever means pivotally connected to the housing, said lever means connected by linkage to the pivotal handle, at one end, and connecting to the lever means at its other end, said lever means slidably connecting with the piston to provide for its elevating or retracting depending upon the direction of pivot provided to the handle during its manipulation, the upper end of the pivot handle having a structure means provided therein, said structure means disposed for engagement by a golf club to provide for the manual pivot to the handle during its forward and rearward pivot while setting up the next golf ball at an elevated position above the platform in preparation for driving of a ball, and pin means operatively associated with the lever means, and provided for entering into the ball channel to regulate the individual delivery of balls to the lowered tee, in preparation for elevating a ball into a golf ball driving position.

2. The golf ball delivery device of claim 1 wherein said tee comprises one of a rubber or polymer tube, with an enlarged base flange provided upon the lower end of said tube, and said flange connecting to the upper side of said piston.

3. The golf bail delivery device of claim 1 and further including a rocker arm operatively associated with the said pin, said rocker arm capable of being actuated by the lever means for providing for the entrance or retracting of the pin within the ball channel, to regulate the individual delivery of golf balls to the tee.

4. The golf ball delivery device of claim 3, and including a ball channel provided vertically within the housing, said ball channel being in open communication with the housing channel, said piston and tee provided for vertically reciprocating within said piston channel, for reception of the next ball upon the tee upon actuation of the pivotal handle with the golf club.

5. The invention of claim 4, and including spring biasing means connecting with the handle, and providing for the automatic elevating of the piston and tee above the surface of the device platform upon release of the handle from the golf club.

6. The golf ball delivery device of claim 3, and including spring means connecting with the rocker arm, and the bias of the spring means providing for the sustained locating of the pin within the ball channel to prevent the gravity movement of subsequent golf balls along said channel and towards the tee during usage of the golf ball delivery device.

7. The golf ball delivery device of claim 1 wherein said structure means comprises a bar means.

* * * * *

UNITED STATES PATENT AND TRADEMARK OFFICE

CERTIFICATE OF CORRECTION

PATENT NO. : 5,330,194

DATED : July 19, 1994

INVENTOR(S) : Copeland, William W.

It is certified that error appears in the above-identified patent and that said Letters Patent is hereby corrected as shown below:

Column 7, claim 1, line 49, change "bal" to ---ball---.

Column 8, claim 3, line 26, change "bail" to ---ball---.

Signed and Sealed this

Twentieth Day of September, 1994

Bruce Lehman

*Attest:*

BRUCE LEHMAN

*Attesting Officer*

*Commissioner of Patents and Trademarks*